United States Patent [19]

Boyce

[11] Patent Number: 4,796,949

[45] Date of Patent: Jan. 10, 1989

[54] ROCKER/GLIDER

[76] Inventor: Ted L. Boyce, P.O. Box 130425, Tyler, Tex. 75713

[21] Appl. No.: 138,181

[22] Filed: Dec. 28, 1987

[51] Int. Cl.[4] ..... A47C 3/02

[52] U.S. Cl. ..... 297/259; 297/270; 297/276; 297/282

[58] Field of Search ..... 297/259, 261, 270, 276, 297/281, 258, 282

[56] References Cited

U.S. PATENT DOCUMENTS

| | | | |
|---|---|---|---|
| 35,307 | 5/1862 | Earnest | 297/270 X |
| 617,438 | 1/1899 | Drew | 297/261 |
| 1,323,946 | 12/1919 | Wright | 297/270 |
| 1,837,911 | 12/1931 | Lillibridge | 297/261 |
| 1,862,953 | 6/1932 | Couch | 297/282 X |
| 2,044,862 | 6/1936 | Smith | 297/281 X |
| 2,095,636 | 10/1937 | Hardy | 297/282 |
| 2,570,000 | 10/1951 | Lowry | 297/282 |
| 4,140,342 | 2/1979 | Jones | 297/261 |
| 4,213,650 | 7/1980 | Sroub | 297/281 |

FOREIGN PATENT DOCUMENTS

| | | | |
|---|---|---|---|
| A2014845 | 9/1979 | United Kingdom | 297/261 |

*Primary Examiner*—Peter A. Aschenbrenner
*Assistant Examiner*—Thomas A. Rendos
*Attorney, Agent, or Firm*—Robert K. Rhea

[57] ABSTRACT

In a rocking glider formed by an elongated horizontal base frame supporting a sub-frame for lateral to and fro movement. A seat and back structure mounted on rockers is supported by the sub-frame for rocking chair-like movement in combination with the gliding action of the sub-frame or individually thereof.

3 Claims, 1 Drawing Sheet

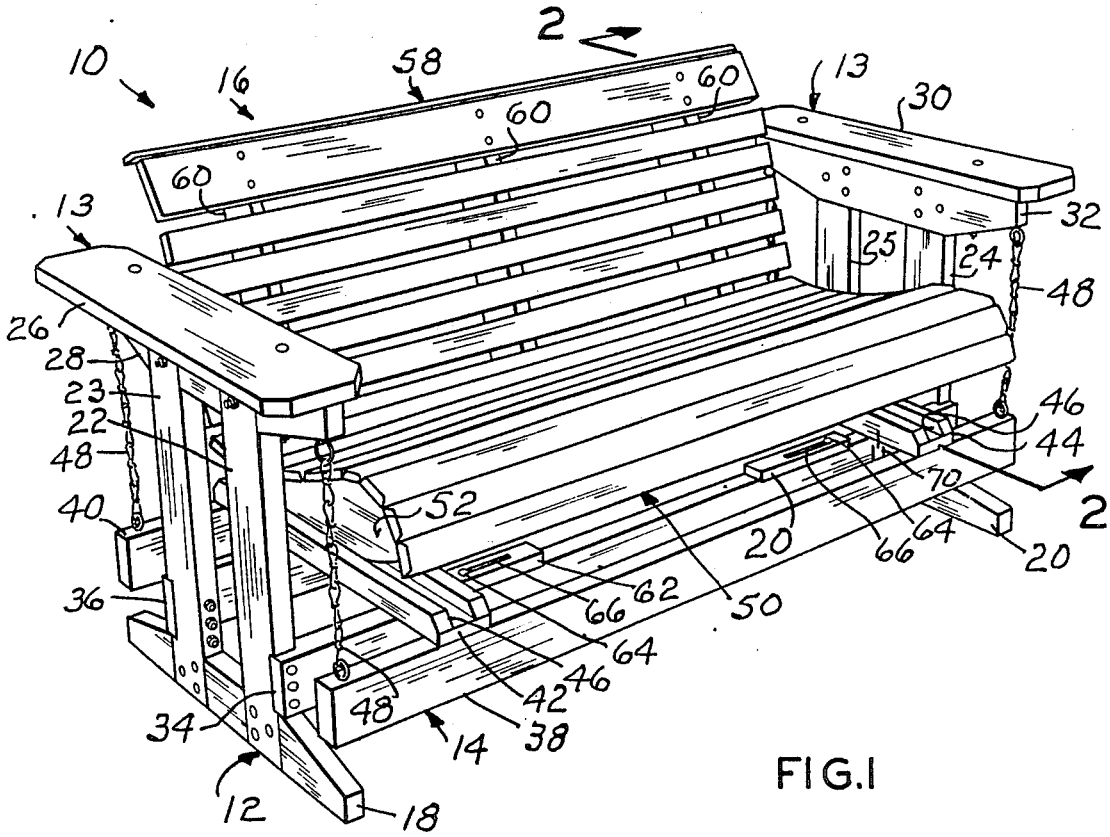
FIG.1
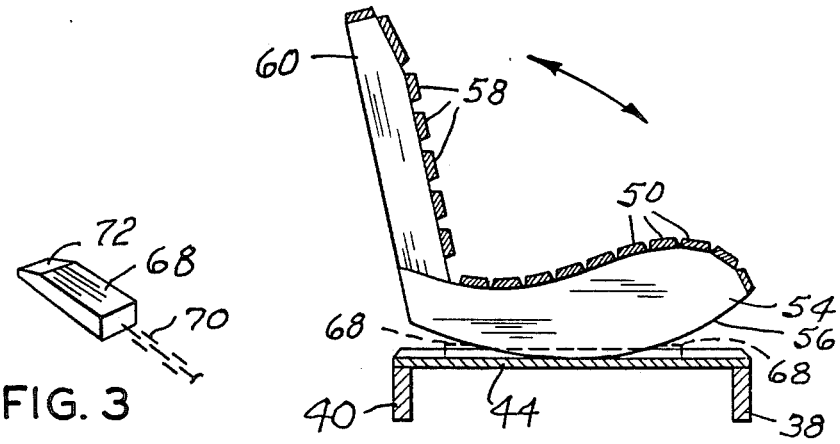
FIG. 2
FIG. 3

ROCKER/GLIDER

BACKGROUND OF THE INVENTION

1. Field of the Invention

This invention relates to patio furniture and more particularly to a combination rocking and swinging glider seat.

2. Description of the Prior Art

Swinging porch or patio seat-like furniture, commonly referred to as "gliders", are well known and generally comprise a rectangular frame horizontally supported by the surface of the porch or patio which in turn supports a seat unit accommodating one or more persons The seat is supported for forward to rearward to and fro swinging movement by a plurality of supports connecting the seat with respective end portions of the horizontal frame. An example of such a glider is disclosed by U.S. Pat. No. 4,213,650.

This invention is distinctive over this patent and other versions of swinging gliders as shown by other patents by rockers underlying the seat and supported by sub-frame members which permits the seat to rock in rocking chair fashion in combination with or separately with respect to the normal gliding action.

SUMMARY OF THE INVENTION

An elongated horizontally disposed open framework provided with upright standards at its respective ends supports, in overlying spaced relation, a horizontal sub-frame suspended from the uprights by pivotally connected strands. An elongated seat, having a seat bottom and backrest, is mounted on a plurality of rockers glidingly nested for rocking movement by transverse sub-frame crossties.

The principal object of this invention is to provide a glider having a seat mounted for a rocking chair-like action in combination with or separately from a forward to rearward gliding movement of the seat and its supporting sub-frame with respect to a stationary seat sub-supporting frame.

BRIEF DESCRIPTION OF THE DRAWINGS

FIG. 1 is a perspective view of the rocking glider;

FIG. 2 a vertical cross sectional view taken substantially along the line 2—2 of FIG. 1; and, FIG. 3 a perspective view, to a larger scale, of a rocker chock, per se.

DESCRIPTION OF THE PREFERRED EMBODIMENTS

Like characters of reference designate like parts in those figures of the drawings in which they occur.

In the drawings:

The reference numeral 10 indicates the rocking glider, as a whole, which is generally rectangular in overall configuration. The device 10 comprises a base frame means 12 having a standard means 13 at its respective ends swingably supporting a sub-frame means 14 in turn supporting, in overlying relation, a rocking seat means 16.

The base frame means 12 comprises transverse base end bar members 18 and 20, each supporting a pair of forward to rearward aligned upright standards 22–23 and 24–25 of selected height. Each pair of standards are respectively transversely interconnected at their upper end portions by frame standard top bars or members 26–28 and 30–32. A pair of base frame bars or stringers 34 and 36 are horizontally connected at their respective ends to respective forward and rearward surfaces of the upright standards 22–23 and 24–25 which rigidly support the frame end standards 13 in upright position.

The sub-frame means 14 comprises a pair of elongated horizontal rails 38 and 40 substantially coextensive with the length of the base frame means 12 and respectively positioned in horizontal forward and rearward spaced relation with respect to the respective forward and rearward stringers 34 and 36.

The rails 38 and 40 are transversely interconnected by a plurality, two in the example shown, of crossties 42 and 44. Each crosstie 42 and 44 is provided with a coextensive upwardly open groove 46 for the purpose presently explained.

The sub-frame 14 is horizontally supported, as a unit, from the end portions of the respective standard top member 28 and 32 by a plurality (four) of flexible connectors, such as chains 48, so that the top surfaces of the rails 38 and 40 lie in a horizontal plane spaced a selected dimension above the horizontal plane defined by the top surfaces of the base frame stringers 34 and 36 for the purpose presently explained. The chains 48 are vertically connected at their respective end portions in a conventional manner, as by screw eyes, anchored in a cooperating end portion of the respective rail 38 and 40 and an overhanging end portion of the respective standard top member 28 and 32. Obviously, the chain 48 could comprise rigid links, if preferred.

The seat means 16 is conventionally formed from a plurality of juxtaposed seat slats 50 transversely secured at their respective end portions by a pair of rockers 52 and 54. The arcuate downwardly facing rocker surface 56 of each rocker is supported by the respective crosstie groove 46 preventing lateral movement of the respective rocker with respect to the respective crosstie but permitting forward to rearward rocking action of the rockers and the seat means.

The seat means backrest similarly comprises a plurality of juxtaposed backrest slats 58 transversely interconnected in rearward and upwardly inclined relation by a plurality of back braces 60 which move with the rockers and seat slats 50 in a rocking chairn action.

OPERATION

Operation of the device seems obvious in that a user seated on the seat means 16 may rock the seat to and fro in a normal rocking chair action while simultaneously a gliding action may be imparted to the sub-frame means 14 by the user's feet contacting a common supporting surface, not shown.

In the event the gliding action is not desired, a pair of elongated glider chocks or stops 62 is mounted, adjacent the respective crosstie 42 and 44, on the top surface of the forward stringer 34 for longitudinal sliding movement relative to and longitudinally of the stringer and is held in place by a pin 64 slidably received by a longitudinal groove in the stop 62. The vertical thickness of the stop 62 is slightly greater than the vertical space between the depending surface of the respective crosstie 42 and 44 so that when the stops are interposed between the respective crosstie and rail 34, by manually lifting the sub-frame means 14 with respect to the base frame means 12, the sub-frame means gliding movement is interrupted.

Similarly, a plurality (four) of rocker stops or chocks, only three being shown, at 68 (FIGS. 2 and 3). are supported from the crossties 42 and 44 by flexible strands 70, only one being shown. When desired the chocks 68 when desired the chocks 68 may be disposed on the crosstie surface defining the bottom of the respective groove 46 where an inclined surface 72 of the respective chock abuts the respective rocking surface 56 to immobilize the rockers 52 and 54 Obviously the invention is susceptible to changes or alterations without defeating its practicability. Therefore, I do not wish to be confined to the preferred embodiment shown in the drawings and described herein.

I claim:

1. A rocking glider, comprising a horizontal base frame including a pair of elongated parallel bars;

upright end frames including horizontal top and bottom bars connected with respective end portions of said parallel bars;

a pair of rails disposed respectively in spaced parallel relation on opposite sides of said parallel bars;

means supporting said pair of rails from said end frames for generally horizontal to and fro movement laterally of said parallel bars;

crossties overlying and transversely interconnecting said rails intermediate their ends, said crossties each having an upwardly open longitudinally extending groove;

seat means including a back mounted on rockers nested in seat means supporting relation by the grooves in said crossties for rocking movement in unison with or independently of the to and fro movement of said pair of rails; and, chock means slidably supported by said bars and selectively interposed between said bars and said crossties for immobilizing said pair of rails horizontal to and fro movement.

2. A rocking glider, comprising:

a horizontal base frame including a pair of elongated parallel bars;

upright end frame including horizontal top and bottom bars connected with respective end portions of said parallel bars;

a pair of rails disposed respectively in spaced parallel relation on opposite sides of said parallel bars;

means supporting said pair of rails from said end frames for generally horizontal to and fro movement laterally of said parallel bars;

crossties overlying and transversely interconnecting said rails intermediate their ends, said crossties each having an upwardly open longitudinally extending groove;

a seat and back structure including spaced parallel seat slats extending longitudinally between said end frames, rockers extending transversely of said seat slats and rockably disposed longitudinally in the respective crosstie groove, said rockers underlying and supporting said seat slats and having a plurality of rear portions extending angularly upward, and, back slats extending between the end frames and supported by said rocker rear portions in cooperative parallel spaced relation; and, chock means slidably supported by said bars and selectively interposed between said bars and said crossties for immobilizing said pair of rails horizontal to and fro movement.

3. The rocking glider according to claim 2 and further including:

rocker stops for immobilizing the seat rocking action.

* * * * *